United States Patent [19]

Goncalves

[11] Patent Number: 4,513,890

[45] Date of Patent: Apr. 30, 1985

[54] CAP FOR A PRESSURIZED CONTAINER AND THE CORRESPONDING UNIT

[75] Inventor: Antonin L. Goncalves, Groslay, France

[73] Assignee: L'Oreal, Paris, France

[21] Appl. No.: 526,514

[22] Filed: Aug. 26, 1983

Related U.S. Application Data

[63] Continuation of Ser. No. 258,291, Apr. 28, 1981, abandoned.

[30] Foreign Application Priority Data

| | | | |
|---|---|---|---|
| May 30, 1980 | [FR] | France | 80 12112 |
| Jan. 23, 1981 | [FR] | France | 81 01221 |
| Feb. 10, 1981 | [FR] | France | 81 02605 |

[51] Int. Cl.[3] ..... B65D 83/14

[52] U.S. Cl. ..... 222/153; 222/182; 222/402.13

[58] Field of Search ..... 222/153, 182, 402.13, 222/402.15, 402.1, 402.12, 402.11

[56] References Cited

U.S. PATENT DOCUMENTS

| | | | |
|---|---|---|---|
| 3,185,350 | 5/1965 | Abplanalp et al. | 222/402.13 X |
| 3,257,044 | 6/1966 | Seaquist | 222/182 X |
| 3,698,604 | 10/1972 | Nigro | 222/402.13 X |
| 4,095,725 | 6/1978 | Goncalves | 222/402.13 X |

FOREIGN PATENT DOCUMENTS

| | | | |
|---|---|---|---|
| 2376036 | 9/1978 | France | 222/182 |

*Primary Examiner*—Robert B. Reeves
*Assistant Examiner*—Russell D. Stormer
*Attorney, Agent, or Firm*—Cushman, Darby & Cushman

[57] ABSTRACT

A presentation cap (10) for an "aerosol spray" container is formed of two parts, the first (11) being fixed to the container and the other (21) being movable to operate the discharge valve (6) of the container. The movable part is a push button (21) connected by a film hinge (35) to a fixed member which is held within, and forms part of, the fixed cap part (11) and rests on the crimped rim (5) of the valve mounting cup (4) of the container. A tamper-proof cover (16) is provided as part of the fixed part (11) of the cap.

29 Claims, 11 Drawing Figures

CAP FOR A PRESSURIZED CONTAINER AND THE CORRESPONDING UNIT

This is a continuation of application Ser. No. 258,291, filed Apr. 28, 1981, now abandoned.

The present invention concerns a presentation cap intended to be associated with a conventional pressurised storage and dispensing container of the "aerosol-spray" type.

The known presentation caps used so far are generally made in two parts, the one fixed, the other movable. The fixed part is formed by a cap body which is fixed, in particular by catch engagement, on the associated pressurised container. The movable part of the presentation cap is in the form of a push button arranged at least partly within the cap body and co-operating with the outlet device of the ejection valve of the pressurized container. Most frequently, the valve is arranged on a mounting cup which is itself fixed by an annular crimped rim on the top part of the container body. Conventionally, the push-button comprises, in its top part, a tongue on which the user acts to cause the valve to open; and at its bottom part it comprises a duct bent at right angles to have an axial leg co-operating with the discharge valve and a radial leg terminating at an ejection nozzle opposite a window in the side wall of the cap body.

Presentation caps of this type may be made either as a single piece or in two separate pieces by moulding plastics material.

In the case of a cap moulded in a single piece, the push-button may be articulated to the fixed cap body by means of an integral or "thin film" hinge obtained by moulding. This type of cap generally has an internal skirt which is coaxial in relation to the external side wall of the cap body; the above mentioned skirt is provided with devices such as catch teeth or a peripheral bead allowing the cap body to be fixed by catch engagement on the crimped rim of the valve mounting cap of the pressurised container.

Alternatively, as illustrated in French Patent Publication No. 2 300 317 of the applicant company, the push button is not articulated in relation to the cap body but is instead slidable along the valve axis of the pressurised container within a central duct arranged in the cap body; on being withdrawn from the mould, the push-button in question is connected to the wall of the cap body by means of tear-off fasteners obtained by moulding.

However, whatever the type of one piece cap embodiment contemplated, the above mentioned caps create two kinds of difficulties, the one occurring during moulding, the other arising when the cap is positioned on the associated pressurised container. In fact, styled presentation caps, particularly if they are moulded as a single piece, have a complex configuration requiring moulds which are expensive to make and which complicate the withdrawal operations from the mould. Moreover, by reason of their design, the majority of present-day presentation caps do not readily lend themselves to automated attachment, practically without manual intervention, to the pressurised container.

The object of the present invention is to overcome the above-mentioned two-fold drawback; for this purpose, it is desired to provide a presentation cap made of two moulded components of a particularly simple shape, affording at one and the same time a saving in raw material in relation to the conventional cap, and a simple and rapid attachment—capable of sustained mechanisation—on a pressurized container. The movable push-button, which forms a component distinct from the cap body, is to be articulated to a sleeve fitted within the cap body. The fixed part of the cap is thus constituted by two elements: on the one hand, the cap body and, on the other hand, the sleeve which is fitted therein and to which the push-button is articulated.

Thus one aspect of the present invention provides a presentation cap for a pressurised container of the "aerosol spray" type, such cap comprising a fixed part and a movable part, wherein the fixed part includes means for attaching it to the body of a pressurised container and further comprises a cap body enclosing a sleeve and provided with means to ensure the angular positioning of the cap body in relation to the sleeve; wherein the movable part of the presentation cap consists of a push button co-operating with the outlet of the dispensing valve of a said associated container; wherein the said push-button includes a dispensing nozzle and a duct communicating the outlet of a said valve with the said dispensing nozzle; wherein the side wall of the cap body includes a window in register with the dispensing nozzle; wherein the push-button is articulated to the sleeve; and wherein the sleeve is intended to abut the body of the pressurised container.

Another aspect of the invention provides a presentation cap mounted on a pressurised container of the "aerosol spray" type, such cap comprising a fixed part and a movable part; wherein the fixed part includes means attaching it to the body of the pressurised container and further comprises a cap body held on the pressurised container, and enclosing a sleeve which abuts the crimped rim of the valve mounting cap of the pressurised container, and means ensuring the angular positioning of the cap body in relation to the sleeve; wherein the movable part of the dispenser cap consists of a push button co-operating with the outlet of the discharge valve of the container; wherein the push-button comprises a dispensing nozzle and a duct communicating the outlet of the valve with the dispensing nozzle; wherein the side wall of the cap body includes a window in register with the dispensing nozzle of the push button; and wherein the push-button is articulated to the sleeve.

The sleeve and associated push-button may be made of a single component by moulding plastics material, the push button being hinged to the sleeve by a hinge obtained by moulding; on withdrawal from the mould, the push button is maintained in a fixed position in relation to the sleeve by means of at least one tear-off fastener obtained by moulding; the push button is substantially arranged within the volume delimited by the sleeve.

The sleeve of the presentation cap is centered within the cap body. It comprises, viewed from the outside, on the one hand two concave opposite components intended to come to bear on the crimped rim of the valve mounting cup and on the other hand, two convex circular arc-shaped components with equal radius of curvature and being diametrically opposite one another, the external diameter of the above-mentioned two convex components being substantially equal to the internal diameter of the cylindrical side wall of the cap body, save for clearance.

In one advantageous embodiment, the cap body comprises, on its inside, means for guiding the push button in a plane which passes through the axis of slide of the outlet device of the valve and is substantially perpendicular to the axis of the articulating hinge. The above-mentioned guiding means are preferably constituted by two side flanges between which the push button is engaged, the two above-mentioned side flanges being arranged on either side of the window of the cap body opposite which the dispensing nozzle of the push button is arranged.

Provision may be made for means limiting the displacement of the push-button about its articulating hinge in the direction opposite that corresponding to opening of the valve; such limiting means consist of at least one lateral stop which is integral with the push-button and is intended to co-operate with the bottom edge of a said guide flange of the cap body.

Advantageously, before the first use of the unit formed by the presentation cap and the associated pressurised container, the opening in the top panel of the cap body allowing the push-button accommodated therein to be manipulated is obturated by a tamper-proof cover which is attached by tear-off fasteners obtained by moulding. If the tamper-proof cover has not been torn off from the cap associated with the container, the user is then certain that the unit which he is acquiring has not been manipulated or at least that it still contains the whole of the product which was packed in the pressurised container by the manufacturer; on the other hand, the breakage or tearing of the tamper-proof cover indicates that the push-button associated with the valve has been manipulated at least once and that the container has thus already been used.

Preferably, the tamper-proof cover is provided in its central zone with a deformable tab allowing the push-button accommodated within the cap body to be manipulated in the factory for the purpose of checking the proper functioning of the unit.

In a first embodiment, the cap body is fixed by means of catch engagement on the pressurised container and ensures that the sleeve bears on the crimped rim of the valve mounting cup of the container. The side wall of the cap body advantageously comprises an interrupted bead engageable within a peripheral groove provided on the barrel of the pressurised container. The body of the associated container is preferably made of a single piece by extrusion of a metal workpiece, for instance of aluminium, and subsequent shaping of the top part of the container body into a bullet, a valve mounting cup then being crimped on to the top part of the container body. On a "one piece" container of this type, which is more specifically described in French Pat. No. 2 177 463 of the applicant company, the peripheral attachment groove of the cap body is arranged on the pressurised container where the bullet-shaped zone connects with the cylindrical side wall of the container body.

However, it is clear that the cap according to this first embodiment may also be attached to all the existing types of pressurised containers, such as the so-called "two piece" containers or "three piece" containers, to the extent that these containers comprise, on their side wall, a peripheral groove to receive the interrupted bead of the cap body.

In this first embodiment, the means facilitating the angular positioning of the cap body in relation to the sleeve also ensure that the sleeve bears on the crimped rim of the valve mounting cup of the pressurised container. The above-mentioned means advantageously comprise at least one stub provided in relief on the inner side wall of the cap body and at least one notch in the sleeve for accommodating the stub.

Preferably in this first embodiment, the sleeve comprises means for pre-centering it in relation to the valve mounting cup of the associated pressurised container. These precentering means are advantageously formed by two studs substantially parallel to the sleeve axis and projecting on the two concave parts of the sleeve, the two studs fitting within the valve mounting cup rim of the pressurised container.

Thus, on withdrawal from the mould of the unit formed by the push-button and the associated sleeve, the push-button is maintained fixed in relation to the sleeve by means of at least one tear-off fastener obtained by moulding, and hence the fitting of the two pre-centering devices within the valve mounting cup automatically entails the co-operation of the duct of the push-button with the outlet of the container discharge valve, without any risk of untimely opening of the valve because as the sleeve bears against the crimped rim of the valve mounting cup, it limits the downward movement of the push-button on the valve.

In the first embodiment, the cap body, which is snap-fitted on the body of the pressurised container, serves in particular to hold the sleeve against the valve mounting cup of the container. Such a mode of assembly does therefore require means for fixing the cap body on the pressurised container, and in particular the existence of a peripheral attachment groove on the side wall of the pressurised container. Moreover prior to the attachment of the cap on the pressurised container, the unit formed by the push button and the associated sleeve constitutes a component which is independent of the cap barrel. Now it is frequently desirable to have a presentation cap available made of a single piece which can be supplied and mounted by the moulder without any additional assembly operation, such a unit simply being snap-fitted on the pressurised container.

In a second embodiment, provision is made for means for attaching the cap on most of the existing pressurised containers whether or not they comprise a peripheral groove on their side wall. The presentation cap advantageously constitutes, before it is mounted on the pressurised container, a preassembled unit wherein the cap body is fixed on the associated sleeve.

In this second embodiment, the sleeve comprises means allowing it to be attached to the crimped rim of the valve mounting cup of the pressurised container. Preferably, the attachment means comprise at least two attachment clips receiving the crimped rim of the valve mounting cup.

Advantageously, the two attachment clips are substantially symmetrical in relation to the sleeve axis, the inner sides of the said clips co-operating with the inner peripheral wall of the crimped rim of the valve mounting cup. The outer side of each attachment clip has a curved profile substantially conforming to the convex curved profile of the crimped rim and terminates in a bead section to be snap-fitted within a peripheral groove arranged in the connecting zone of the crimped rim with the barrel of the pressurised container when the sleeve bears on the crimped rim.

In this second embodiment the sleeve is fixed by snap-fitting, on the crimped rim of the valve mounting cup of the pressurised container. The cap body thus no longer has the function of maintaining the bearing of the sleeve on the crimped rim of the valve mounting cup and it may be fixed either on the barrel of the pressurised container or on the sleeve.

It is preferable for the cap body to be fixed on the sleeve by snap-fitting. In this case, the side wall of the cap body advantageously comprises at least one inner notch co-operating with the peripheral edge of the sleeve which comes to bear on the crimped rim of the valve mounting cup when the peripheral edge facing the sleeve substantially abuts an element which is integral with the cap body. The two guide flanges of the cap body engage within two cut-outs cut in the convex curved parts of the sleeve, and advantageously form the element of the cap body against which the sleeve abuts.

The assembly of this second embodiment of cap on a pressurised container may be effected in two different ways:

- either one first fixes the sleeve associated with the push button to the pressurised container and then the cap body on the sleeve;
- or the sleeve associated with the push button is snap-fitted to the inside of the cap body and then this unit is fixed on to the pressurised container.

It is clear that, depending on the shape of the end of the push-button, the cap may co-operate either with a discharge valve of the type having an emerging stem or with a valve of the type not having such an emerging stem.

In order that the present invention may more readily be understood, the following purely illustrative and non-restrictive description is given of two embodiments, with reference to the accompanying drawings in which.

Figure 1:
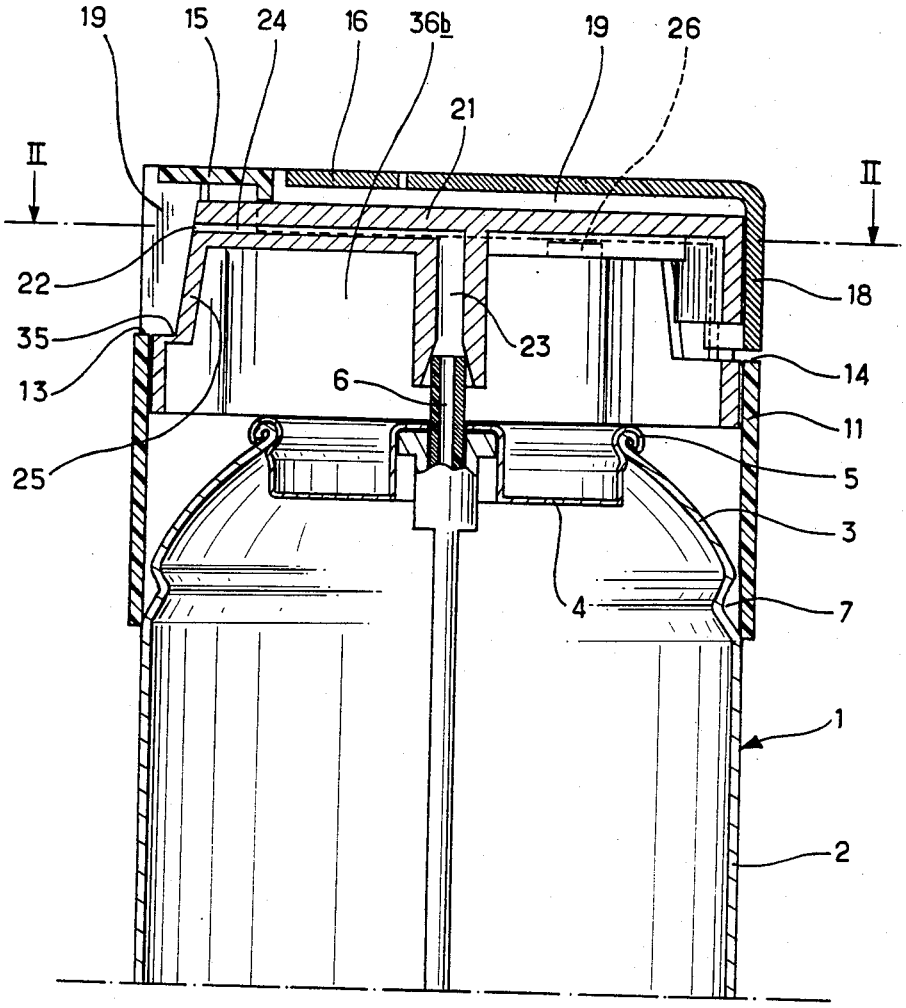
FIG. 1 is an axial cross section showing the top part of a pressurised container provided with a first embodiment of presentation cap according to the invention, the sleeve being kept held against the crimped rim of the valve mounting cup by means of the cap body snap-fitted on to the body of the container, FIG. 1 being a cross section along the line I—I of FIG. 2.
Figure 2:
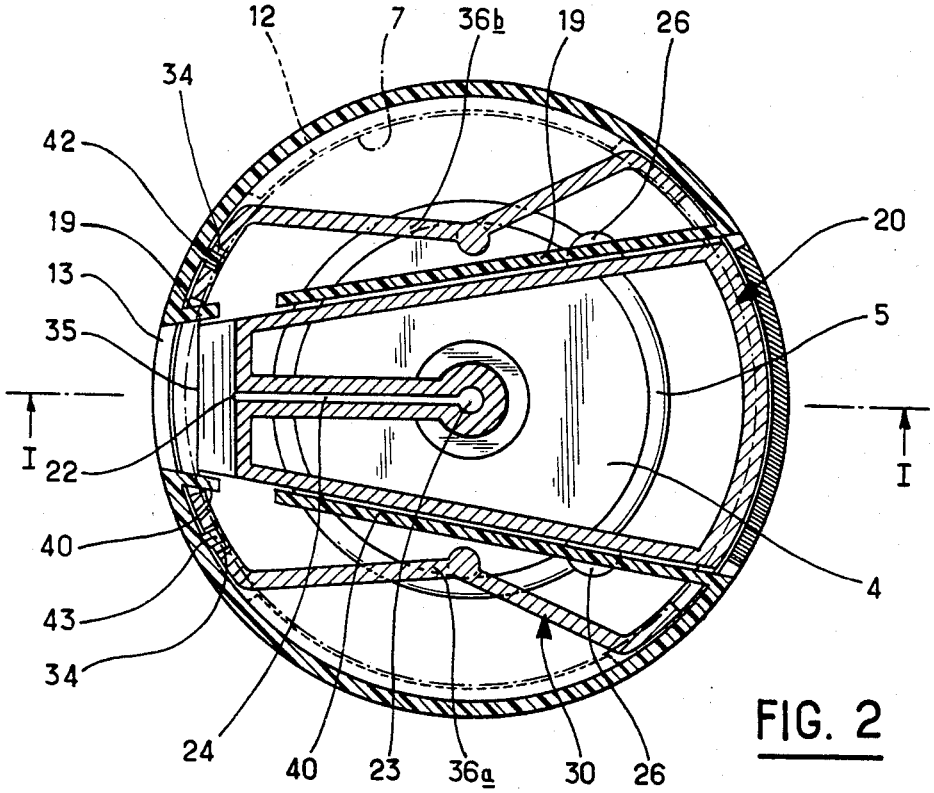
FIG. 2 is a cross section along II—II of FIG. 1.
Figure 3:
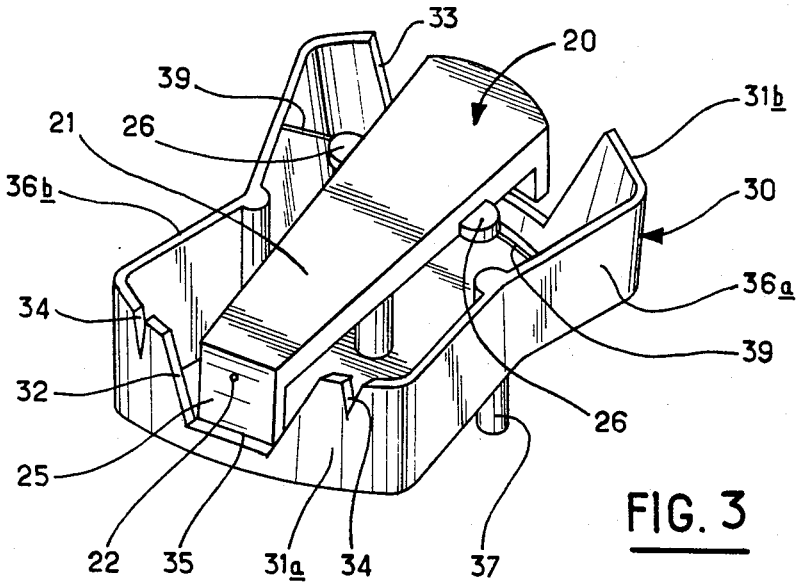
FIG. 3 is a perspective view of the push-button-sleeve unit of the cap of FIGS. 1 and 2.
Figure 4:
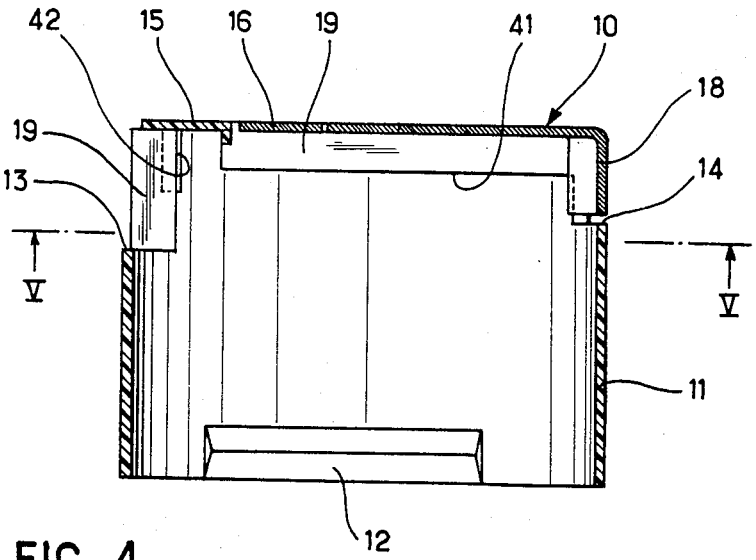
FIG. 4 is an axial cross section of the cap body alone, taken along IV—IV of FIG. 5.
Figure 5:
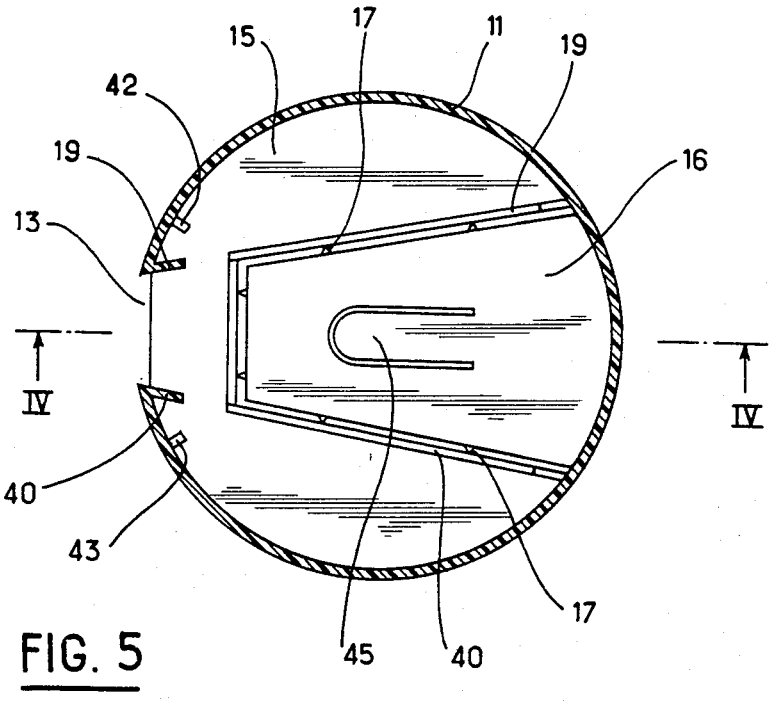
FIG. 5 is a cross section along line V—V of FIG. 4.
Figure 6:
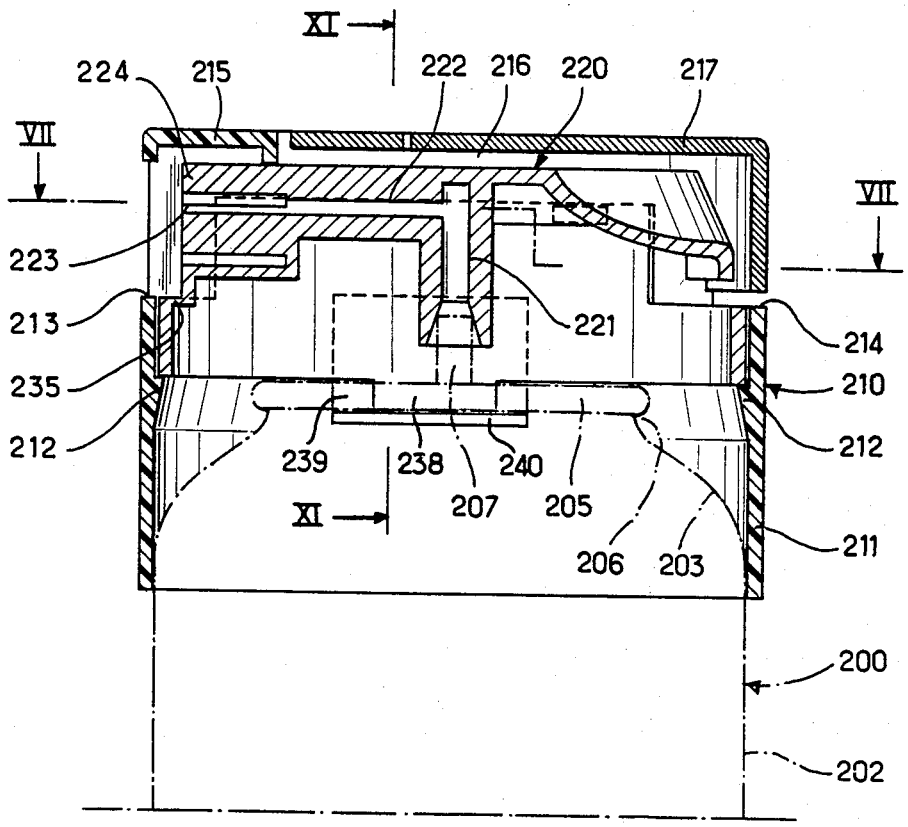
Figure 7:
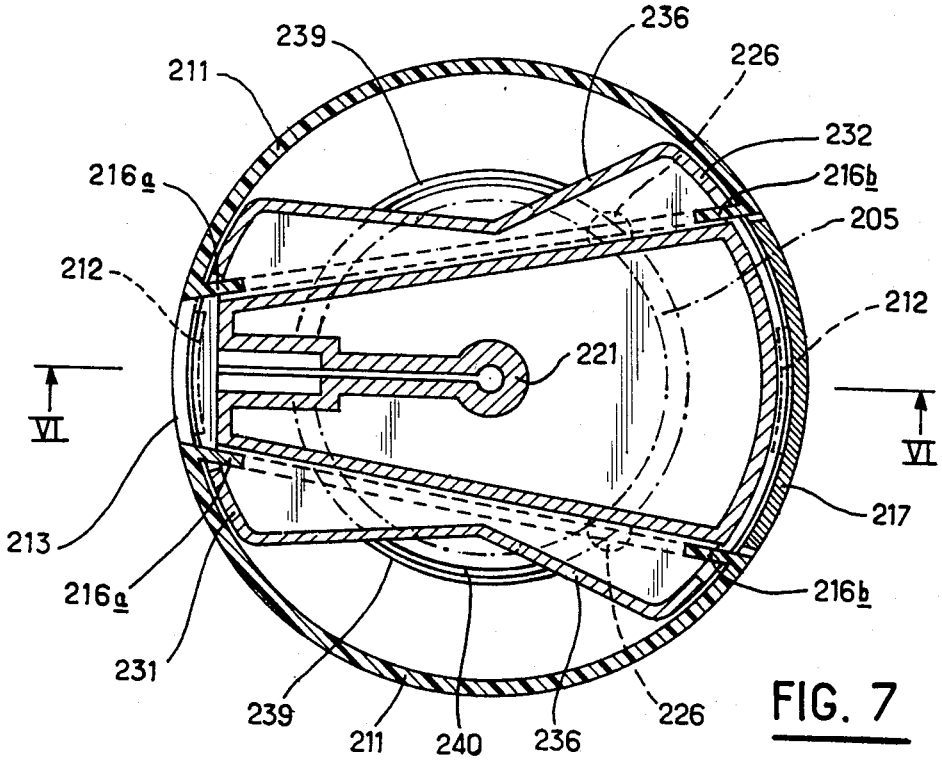
Figure 8:
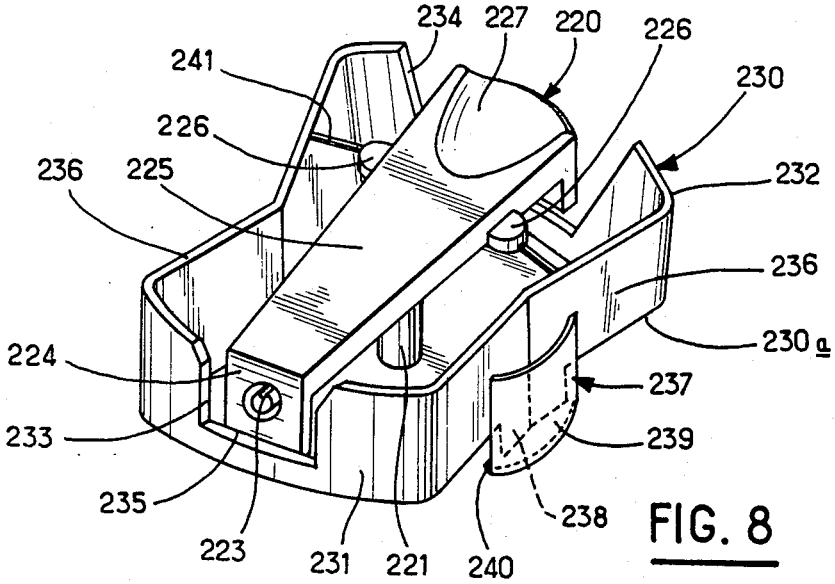
Figure 9:
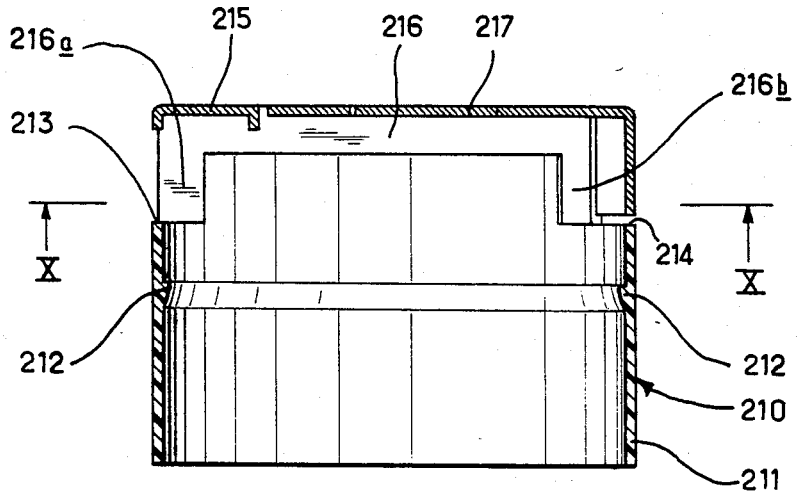
Figure 10:
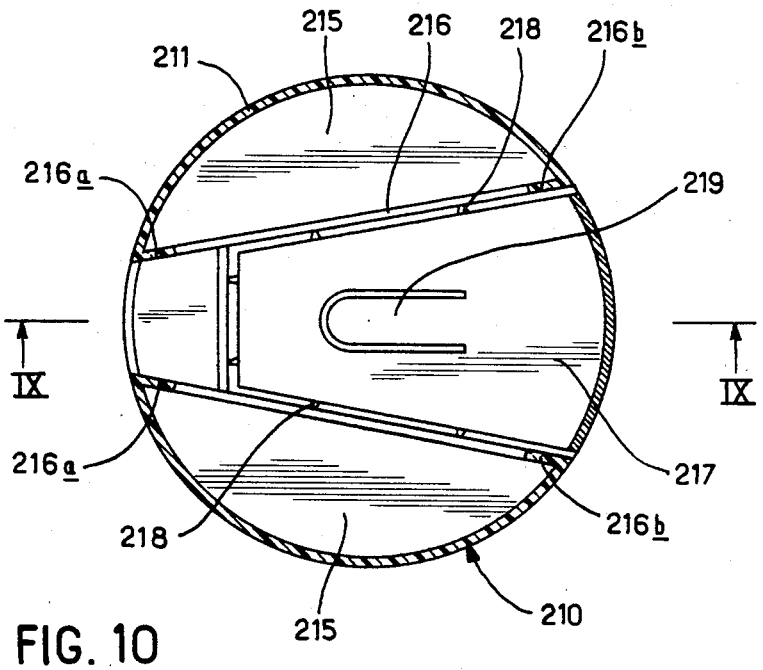

FIG. 6 is an axial cross section of a second embodiment of presentation cap according to the invention, the cap body being snap-fitted on to the sleeve which itself is fixed by catch engagement on to the crimped rim of the valve mounting cup, the top part of the associated pressurised container being shown in dot-dash lines, and the view of FIG. 6 being a cross section taken along line VI—VI of FIG. 7;

FIG. 7 is a transverse cross section along line VII—VII of FIG. 6;

FIG. 8 is a perspective view of the push-button/-sleeve unit of the cap of FIGS. 6 and 7;

FIG. 9 is an axial cross section of the cap body, taken along line IX—IX of FIG. 10;

FIG. 10 is a cross section along line X—X of FIG. 9; and

Figure 11:
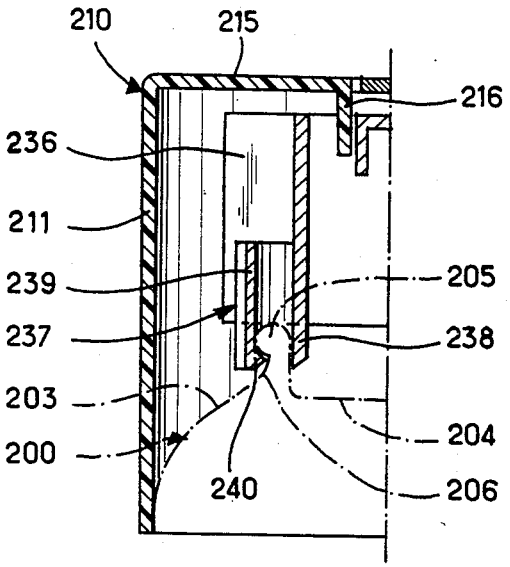

FIG. 11 is a part cross section along line XI—XI of FIG. 6.

Referring to FIGS. 1 to 5, there will be seen a pressurised container, generally designated 1, of the "aerosol spray" type obtained, for example, by die stamping and forming of an aluminium pellet. Container 1 comprises a bottom (not shown), a cylindrical side wall 2 and a bullet-shaped top part 3. A valve mounting cup 4 is fixed at the tip of bullet 3 by an annular crimped rim 5. In the central portion of the cup 4, is a valve whose outlet device consists of an axially slidable discharge tube 6. In the zone where the cylindrical side wall 2 of the container and the bullet 3 are joined, a peripheral retaining groove 7 is formed.

The top part of the pressurised container 1, of the known type, receives a dispenser cap constituted by two pieces of a moulded plastics material comprising, on the one hand, a cap body generally designated 10 and, on the other hand, a unit moulded of a single component and comprising a push button 20 and a sleeve 30.

The push button 20 comprises, on its top part, a tongue 21 extending radially of the cylindrical wall 11 of the cap body 10. The longitudinal sides of the tongue 21 converge slightly in the direction along the ejection nozzle 22 of the push button.

In its lower part, the push button 20 comprises an L-shaped duct having an axial leg 23 to receive the discharge tube 6 of the valve and a radial leg 24 terminating at the ejection nozzle 22 opening on a front wall 25 of the push-button. Provision is made on each longitudinal side of tongue 21 for a lateral relief stop 26. The push-button 20 is accommodated within sleeve 30 (FIG. 3) coaxial with the discharge tube 6 of the valve. Sleeve 30, with its push-button 20, is obtained by moulding. Viewed from the outside, it comprises two diametrically opposed convex circular arc-shaped parts 31*a*, 31*b* having the same radius of curvature. Save for the necessary clearance, the outer diameter of the two convex parts 31*a*, 31*b* is substantially equal to the internal diameter of the lateral cylindrical side wall 11 of the cap body. Two trapezoidal cut-outs 32, 33 are provided on the two convex curved parts 31*a*, 31*b* of sleeve 30.

Two small triangular notches 34 are arranged on the convex curved part 31*a* of sleeve 30, on either side of the trapezoidal cut-out 32. At the bottom of the trapezoidal cut-out 32, connected thereto by an integral hinge (a so-called film hinge) 35, obtained by moulding, is the base of the front wall 25 of push button 20. This push button 20 includes the ejection nozzle 22. Hinge 35 constitutes the articulation means of push button 20 enabling it to tilt.

Sleeve 30 also comprises two symmetrical concave parts 36*a*, 36*b* intended to abut the crimped rim 5 of container 1. In the central zone of the two concave parts 36*a*, 36*b* of sleeve 30 are two parallel studs 37 arranged symmetrically on either side of the axis of sleeve 30. These studs 37, which fit inside the valve mounting cup 4 of container 1, ensure the pre-centering of the sleeve 30 and therefore of the push button 20 on the axis of the discharge tube 6 of the valve, prior to the fitting of the cap body 10 on the container 1.

On withdrawal from the mould the push button 20 is kept fixed within sleeve 30, by means of two tear off strips 39 (FIG. 3) obtained by moulding. In this way, by a simple operation of locating the two pre-centering studs 37 within the valve mounting cup 4 until sleeve 30 comes to bear on the peripheral crimped rim 5, the discharge tube 6 of the valve can be automatically fitted within the axial duct leg 23 of the push button 20.

The side wall 11 of the cap body is provided on its lower part with an interrupted bead 12 in two sections, which ensures substantially irremovable fixing of the cap body 10 on the top part of container 1, by catch engagement within the preformed peripheral groove 7.

A window 13 and a recess 14, diametrically opposed to each other, are formed in the top part of the side wall 11 in the zone of juncture with the top wall 15 of the cap body 10. Opposite the window 13, is the front wall 25 of push button 20, the ejection nozzle 22 being arranged in this front wall. The two facing cut-outs 32, 33 of the sleeve 30 come into register with a window 13 and a recess 14 (FIG. 4), respectively, of the cap body 10. The purpose of the recess 14 is to facilitate the depressing action on the push button 20 within cap body 10 by means of the user's finger.

An opening, having the shape and dimensions of tongue 21 or the push button 20, is formed on the top side 15 of the cap body. The above-mentioned opening is obturated by a protective cover 16 connected with the top side 15 of the cap body, by tear off fasteners 17 obtained by moulding. The protective cover 16 is also provided with a right angle bend 18 having a rounded shape which comes to be substantially accommodated within the recess 14 of the top part of the side wall 11. A pre-formed tab 45 is provided in the central zone of the protective cover 16. In the factory, the depression of the tab 45 by means of a special tool allows the atomisation of the product contained in the container to be checked without removal of or even damaging the protective cover 16.

The side edges of the window 13 and recess 14 are joined respectively by two guide flanges 19, 40 extending into the inside of the casing 10. The two guide flanges 19, 40 limit the two longitudinal edges of the opening cut into the top side 15 of the cap body 10. They are arranged symmetrically on either side of the axis of the cap body and they substantially converge towards window 13. The two guide flanges 19, 40 are interrupted (FIGS. 2 and 4) near the window 13. The ends of the two guide flanges 19, 40 become positioned within the two cut-outs 32, 33 of sleeve 30, whilst the tongue 21 of the push button becomes accommodated between the two flanges with scope for deflection. The function of the two flanges 19, 40 is to guide the push button 20 in a plane passing through the axis of movement of the outlet tube 6 of the valve and through the axis of window 13.

The two side stops 26, provided on either side of tongue 21 of push button 20, are intended to co-operate with the lower edge 41 (FIG. 4) of the two guide flanges 19, 40 so as to limit the angular deflection of push button 20 around its film hinge 35 in the direction opposite to that corresponding to depression of the discharge tube 6 of the valve and hence opening of the said valve.

Two inner lugs 42, 43 are provided in relief on side wall 11 of the cap body on either side of window 13. The above mentioned two lugs 42, 43 engage in the two triangular notches 34 of sleeve 30. The co-operation of lugs 42, 43 and of the notches 34 has the object of, on the one hand, causing the sleeve 30 to abut the annular crimped rim 5 and, on the other hand, ensuring angular positioning of the cap body in relation to sleeve 30.

The assembly of the above described presentation cap on the pressurized container 1 is advantageously effected on an automated machine. The push button 20 is positioned in the axis of the discharge tube 6 of the valve, and is then lowered during which the co-operation of the two studs 37 with the inner circular wall of the valve mounting cup 4 ensures the axial alignment of the axes of the discharge tube 6 of the valve and of the push button 20 so that the discharge tube 6 is automatically lowered within the axial duct leg 23 of the push button.

In the same way the cap body 10 is presented above the pressurised container 1, on which the unit formed by the push button 20 and sleeve 30 has already been positioned, such that the cap body is angularly orientated in relation to this unit so that the ejection nozzle 22 should come to be opposite the window 13. The cap body 10 is then fitted on the top part of container 1 until catch engagement of the interrupted bead 12 within the peripheral groove 7 of the container occurs. On termination of this assembly operation, the sleeve 39 is held fixed within the cap body 10 whilst constituting an independent component of the cap body which allows the dimensional tolerances existing between the peripheral groove 7 and the top part of the annular crimped rim 5 of container 1 to be compensated.

Referring to FIGS. 6 to 11, there will be seen a pressurised container of the conventional type, designated by 200 as a whole. The body of this container is, for example, made of a single component by die stamping and forming of an aluminium pellet. It comprises a bottom (not shown), a cylindrical side wall 202, and a bullet-shaped top part 203. A valve mounting cup 204 is fixed at the end of the bullet 203 by means of an annular crimped rim 205.

The zone joining the crimped rim 205 on the end of bullet 203 delimits a peripheral groove 206. In the central portion of cup 204, there is arranged a valve whose outlet device is formed by an axially slidable emerging stem or tube 207.

The presentation cap associated with the pressurised container 200 comprises, on the one hand, a cap body 210 and, on the other hand, a unit moulded from a single component and consisting of a push button 220 and a sleeve 230.

The push button 220 comprises an L-shaped duct whose axial leg 221 receives the discharge tube 207 of the valve and whose radial leg 222 opens, via its end 223, on a front wall 224. The above-mentioned end 223 accommodates an atomising nozzle (not shown). The L-shaped duct of the push button 220 is surmounted by a tongue 225 (FIG. 8) comprising two lateral edges substantially converging towards the ejection nozzle of the push button. Tongue 225 also comprises, at its top part, a hollowing out 227 which comes to accommodate the user's finger when the push button 220 is to be depressed.

Push button 220 is accommodated within sleeve 230 whose axis is substantially identical with that of the outlet tube 207 of the valve. Sleeve 230 has two diametrically opposed convex circular arc-shaped parts 231, 232 having the same radius of curvature. Save for the clearance, the outer diameter of the two convex parts 231, 232 is substantially equal to the inner diameter of the side wall 211 of the cap body. Two opposite cut-outs 233, 234 are formed in the curved convex parts 231, 232 of the sleeve.

At the bottom of the cut-out 233 the front wall 224 of the push button (which includes the ejection nozzle) is attached by a film hinge 235 obtained by moulding. Hinge 235 constitutes the articulation about which the push button 220 may pivot.

Sleeve 230 also has two symmetrical concave parts abutting the crimped rim 205 of the valve mounting cup. In the central zone of the concave part 236, provision is made for two attachment clips 237 to substantially irremovably fix the sleeve 230 on the crimped rim 205 of the valve mounting cup. The two attachment clips 237 are moulded simultaneously with sleeve 230. They are substantially symmetrical in relation to the sleeve axis, and they project in relation to the peripheral edge 230*a* of the sleeve which abuts the crimped rim 205 of the valve mounting cup. The adjacent sides 238 of the two attachment clips 237 are arranged within the valve mounting cup and co-operate with the inner peripheral edge of the crimped rim 205; they thus ensure the centering of sleeve 230 and hence of push button 220, on the axis of the outlet tube of the valve. The centering clips 237 are obtained by extending the central zone of the concave parts 236 of the sleeve downwardly.

The two opposite wings 239 of the attachment clips co-operate with the outer peripheral edge of the crimped rim 205. They are diametrically opposite each other and have a circular arc-shaped curved profile of the same radius of curvature. Save for the clearance, the inner diameter of the two wings 239 is substantially equal to the outer diameter of the crimped rim 205. The two wings 230 each end in a catch bead 240 which, when the sleeve 230 comes to bear on the crimped rim, becomes snap-fitted on the crimped rim 205 within the peripheral groove 206.

On withdrawal from the mould, the push button 220 is retained within sleeve 230 by means of two tear off strips 241 obtained by moulding (FIG. 8).

The cap body 210 comes to be fixed on sleeve 230. A window 213 and a diametrically opposite recess 214 are formed in the top part of the cylindrical side wall 211 in the zone where it joins the top side 215 of the cap body 210. The two side edges of the window 213 and of recess 214 are respectively joined by two guide flanges 216 extending within the cap body 210. The two guide flanges 216 are arranged symmetrically on either side of the axis of the cap body and substantially converge towards the window 213. They are joined to the top side 215 of the cap body.

The push button 220 is arranged within the cap body 210 between the two guide flanges 216. The co-operation of the two side edges of tongue 225 of the push button with the two guide flanges 216 ensures the deflection of push button 220 substantially in a plane which passes through the axis of sliding of the discharge tube 207 of the valve and extends perpendicularly to the axis of the articulating film hinge 235. The two side stops 226, provided on either side of tongue 225 of the push button, co-operate with the lower edge of the two guide flanges 216 so as to limit the angular deflection of the push button 220 around its articulating hinge 235 in the direction opposite to that corresponding to depression of the outlet tube 207 of the valve and hence to opening of the valve.

The two guide flanges 216 of the cap body become placed, by their projecting ends 216*a*, 216*b*, within the two opposite cut-outs 233, 234 of the sleeve 230. Thus they ensure the angular positioning of the cap body 210 in relation to the sleeve 230 and, hence, to the associated push button 220, so that the ejection nozzle of the push button is located opposite the window 213 of the cap body.

Two diametrically opposite attachment catches 212 are provided in relief within the side wall 211 of the cap body, below the window 213 and the recess 214. In the assembled position the sleeve 230 comes to bear, substantially by the lower edge of its two convex parts 231, 232, on the two attachment catches 212 of the cap body while simultaneously the ends 216*a*, 216*b* of the two guide flanges 216 come to abut substantially against the bottom of the two cut outs 233, 234 of the sleeve.

An opening, whose two opposite side edges are delimited by the two guide flanges 216, is arranged in the side 215 of the cap body. The above-mentioned opening is obturated by a protective cover 217 connected with tear off fasteners 218, formed by moulding with the top side 215 of the cap body. A pre-formed tab 219 (FIG. 10) is arranged in the part of the protective cover 217 at the centre of the top side 215. In the factory, the depression of the pre-cut tab 219 by means of a tool makes it possible to actuate the push button 220 and to check atomisation of the product packed in the pressurised container, without removing or damaging the protective cover 217.

The operation of assembling the dispenser cap on the pressurised container 200 may be effected as follows. The unit formed by sleeve 230 and the adjoining push button 220 is fixed on the valve mounting cup of the container by snap-fit engagement of the crimped rim 205 within the two attachment clips 237 of the sleeve. During this manipulation, the outlet tube 207 is automatically depressed into the axial duct leg 221 of the push button.

The cap body 210 is then presented above the pressurised container and is orientated angularly in relation to sleeve 230 so that the ends of the two guide flanges 216 may penetrate into the two cut-outs 233, 234 of the sleeve. The cap body 210 is then force-fitted on the sleeve 230 to allow the sleeve to be crossed by the two attachment catches 212 of the cap body. This depression movement is continued until the lower edge of the sleeve abuts the two attachment catches 212, and the ends 216*a*, 216*b* of the two guide flanges 216 come to abut against the bottom of the two cut-outs 233, 234 of the sleeve. The cap body 210 is then found to be fixed to the sleeve which itself is catch-fitted on the crimped rim of the valve mounting cup.

In another alternative assembly sequence the sleeve 230 and its adjoining push button 220 may be first fixed within the cap body 210, and then this unit will be catch-fitted on the crimped rim of the pressurised container.

It shall be duly understood that the two embodiments described above are in no way restrictive and may give rise to any desirable modifications without thereby departing from the scope of the invention as defined by the claims.

I claim:

1. A presentation cap for a pressurised "aerosol spray" container, such cap comprising: fixed cap means including a cylindrical cap body having a side wall and a top wall provided with an opening, means effective to attach the cap body to a pressurised container, a sleeve within the cap body, said sleeve having mutually opposite concave wall portions curved with respect to the axis of said cylindrical cap body and facing radially outwardly, said concave wall portions having lower edges adapted to bear on top of a crimped rim of a valve mounting cup of a spray container, and said sleeve having at least two opposite arcuate convex wall portions in engagement with the cap body, means defining a window in said cap body side wall, and means for ensuring angular positioning of the cap body on said sleeve; movable cap means comprising a push button disposed in said opening in said cap body top wall so as to be maneuverable by a user's finger, said push button having first and second ends, means on said push button for receiving the outlet of a discharge valve of a said pressurised container, means at the first end of said push button defining a dispensing nozzle of said push button, said dispensing nozzle being located at one of said opposite wall portions of said sleeve, and means defining a duct communicating said valve outlet receiving means with said dispensing nozzle; and hinge means pivotally attaching said push button to said sleeve, said hinge means being located at said one opposite wall portion of said sleeve whereby said hinge means is located immediately adjacent said cap body side wall, with said dispensing nozzle in register with said window of the cap body.

2. A cap according to claim 1, wherein the sleeve is centered within the cap body.

3. A cap as in claim 1 wherein said hinge means is a hinge strip extending parallel to the axis of the sleeve, the strip having a lower end joined to said one opposite wall portion of said sleeve and having an upper portion lying essentially in the plane of the discharge opening of said dispensing nozzle.

4. A cap as in claim 3 wherein each of said opposite wall portions of said sleeve is provided with a cut-out, said hinge strip and dispensing nozzle being disposed immediately adjacent the cut-out in said one wall portion and the second end of said push button being disposed immediately adjacent the cut-out in the other wall portion of said sleeve.

5. The combination of a presentation cap fastened on a pressurised "aerosol spray" container having a valve mounting cup with a crimped rim, and a discharge valve having an outlet, such cap comprising: (a) fixed cap means including a cap body having a cylindrical side wall, means attaching the cap body to said pressurised container, a sleeve within the cap body, said sleeve having mutually opposite concave wall portions curved with respect to the axis of said cylindrical cap body and facing radially outwardly, said concave wall portions having lower edges bearing on top of the crimped rim of the valve mounting cup, and said sleeve having at least two opposite arcuate convex wall portions in engagement with the cap body, means for centering the sleeve within the cap body, means defining a window in said cap body side wall, and means for ensuring angular positioning of the cap body in relation to said sleeve; (b) movable cap means comprising a push button, means on said push button for receiving the outlet of said discharge valve of the pressurised container, means defining a dispensing nozzle of said push button, said dispensing nozzle being located at one of said opposite wall portions of said sleeve, and means defining a duct communicating said valve outlet receiving means with said dispensing nozzle; and means pivotally attaching said push button to said sleeve, said hinge means being located at said one opposite wall portion of said sleeve whereby said hinge means is located immediately adjacent said cap body side wall with said dispensing nozzle in register with said window of the cap body.

6. A combination according to claim 4, wherein the means attaching the cap body to the pressurised container comprise catch engagement means carried by said concave parts and holding the sleeve on the crimped rim of the valve mounting cup of the container.

7. A combination according to claim 6, wherein the container body includes a peripheral groove, and the cylindrical side wall of the cap body includes an interrupted annular bead engaged within the peripheral groove.

8. A combination according to claim 7, wherein the pressurised container has been formed by die stamping and forming of a metal pellet, and is bullet-shaped in a zone which is opposite its bottom, said valve mounting cup being fixed by crimping at the tip of the bullet-shaped zone.

9. A combination according to claim 8, wherein the peripheral groove is formed where said bullet-shaped zone connects with the lateral cylindrical wall of the body of the container.

10. A combination according to claim 6, wherein the means angularly positioning the cap body in relation to the sleeve are also effective to hold the sleeve on the crimped rim of the valve mounting cup of the container.

11. A combination according to claim 10, wherein the means angularly positioning the cap body in relation to sleeve and with comprise stub means provided in relief on the inner side wall of the cap body and notch means on the sleeve to accommodate the lug means.

12. A combination according to claim 5, wherein the push-button is substantially arranged within the space delimited by the sleeve.

13. A combination according to claim 5, wherein the push button is made of a single piece with the sleeve and with the hinge means by the moulding of plastic material.

14. A combination according to claim 13, wherein the push button and the sleeve are arranged such that, on withdrawal from the mould, the push button is held fixed within the sleeve by means of tear-off fastener means obtained by moulding.

15. A combination according to claim 5, wherein the cap body comprises, internally, means for guiding the push button in a plane which passes through the axis of movement of the outlet of the discharge valve and is perpendicular to the axis of the hinge means.

16. A combination according to claim 15, wherein said guide means comprise two guide flanges between which the push button is engaged, said guide flanges being disposed on either side of said window of the cap body side wall.

17. A combination according to claim 5 wherein the push button is made of a single piece with the sleeve and with the hinge means by the moulding of plastic material, wherein the cap body comprises, internally, guide means for guiding the push button in a plane which passes through the axis of movement of the outlet, of the discharge valve and is perpendicular to the axis of said hinge means, said guide means comprising two guide flanges between which the push button is engaged, said guide flanges being disposed on either side of said window in said cap body side wall, and means for limiting deflection of the push button about said hinge means in the direction opposite to that corresponding to the opening of the discharge valve, said limiting means including lateral stop means integral with the push button and co-operating with the lower edge of a said guide flange of the cap body.

18. A combination according to claim 5, wherein said cap body has a top panel and means defining an opening in the top panel to allow manipulation of the push button; and including tamperproof cover means closing said opening means, and tearoff fastener means obtained by moulding for connecting said cover means to the top panel.

19. A combination according to claim 18, wherein said cover means is provided with a deformable tab allowing the push button housed within the cap body to be manipulated.

20. A combination according to claim 5, wherein the sleeve comprises means pre-centering it in relation to the valve mounting cup of the pressurised container.

21. A combination according to claim 5 wherein said cap body side wall is cylindrical, wherein the sleeve comprises, viewed from the outside, two mutually opposite concave parts bearing on the crimped rim of the valve mounting cup and two mutually diametrically opposed convex circular arcuate parts of equal radius of curvature, the outer diameter of the two convex parts being substantially equal to the inner diameter of the cylindrical side wall of the cap body save for a clearance, wherein the sleeve includes means pre-centering it to the valve mounting cup of the pressurised container, and wherein the pre-centering means comprise two studs substantially parallel to the axis of the sleeve and projecting from said two concave parts of the sleeve, said two studs fitting inside the crimped rim of the valve mounting cup of the container.

22. A combination according to claim 5, wherein the sleeve comprises means fastening it on the crimped rim of the valve mounting cup of the pressurised container.

23. A combination according to claim 22, wherein the fastening means of the sleeve comprise at least two clips to receive the crimped rim of the valve mounting cup.

24. A combination according to claim 23, wherein the two fastening clips are substantially symmetrical in relation to the axis of sleeve and have inner sides co-operating with the outer peripheral wall of the crimped rim.

25. A combination according to claim 23, wherein each fastening clip has an outer side having a curved profile substantially conforming to the convex curve profile of the crimped rim and terminating in a bead which, when the sleeve bears on the crimped rim, engages within a peripheral groove between the crimped rim and an adjacent zone of the body of the pressurised container.

26. A combination according to claim 22, including snap fit means holding the cap body on the sleeve.

27. A combination according to claim 26, wherein the sleeve has a first peripheral edge which abuts the crimped rim of the valve mounting cup, and wherein the side wall of the cap body comprises at least one inner catch co-operating with a second peripheral edge of the sleeve when said second peripheral edge of the sleeve abuts an element which is integral with the cap body, the first and second peripheral edges being at opposite ends of the sleeve.

28. A combination according to claim 5 wherein said cap body includes snap fit means holding the cap body on the sleeve, wherein said cap body side wall is cylindrical, wherein the sleeve comprises, viewed from the outside, two mutually opposite concave parts bearing on the crimped rim of the valve mounting cup and two mutually diametrically opposed convex circular arcuate parts of equal radius of curvature, the outer diameter of the two convex parts being substantially equal to the inner diameter of the cylindrical side wall of the cap body save for a clearance, wherein the sleeve comprises means fastening it on the crimped rim of the valve mounting cup of the pressurised container, said fastening means including at least two clips to receive said crimped rim, each clip having an outer side having a curved profile substantially conforming to the convex curve profile of the crimped rim and terminating in a bead which, when the sleeve bears on the crimped rim, engages within a peripheral groove between the crimped rim and an adjacent zone of the body of the pressurised container, and wherein the sleeve has a first peripheral edge which abuts the crimped rim of the valve mounting cup, and wherein the side wall of the cap body comprises at least one inner catch co-operating with a second peripheral edge of the sleeve when said second peripheral edge of the sleeve abuts an element which is integral with the cap body, the first and second peripheral edges being at opposite ends of the sleeve, and wherein the cap body comprises guide flanges for guiding the push button for movement in a plane which passes through the axis of movement of the discharge valve outlet, and is perpendicular to the axis of articulation of the hinge means, said guide flanges being disposed on either side of the window and enclosing the push button therebetween; and wherein the curved convex part of the sleeve includes means defining cut outs receiving said guide flanges.

29. A presentation cap for a pressurised "aerosol spray" container, such cap comprising: fixed cap means including a cap body having a cylindrical side wall and a top wall provided with an opening, means effective to attach the cap body to a pressurised container, a sleeve within the cap body, said sleeve having mutually opposite concave wall portions curved with respect to the axis of said cylindrical cap body and facing radially outwardly, said concave wall portions having lower edges adapted to bear on top of a crimped rim of a valve mounting cup of a spray container, and said sleeve having at least two opposite arcuate convex wall portions in engagement with the cap body, means defining a window in said cap body side wall, and means for ensuring angular positioning of the cap body on said sleeve; movable cap means comprising a push button disposed in said opening in said cap body top wall so as to be maneuverable by a user's finger, said push button having first and second ends, means on said push button for receiving the outlet of a discharge valve of a said pressurised container, means at the first end of said push button defining a dispensing nozzle of said push button, said dispensing nozzle being located at one of said opposite wall portions of said sleeve, and means defining a duct communicating said valve outlet receiving means with said dispensing nozzle; and hinge means pivotally attaching said push button to said sleeve, said hinge means being a hinge strip extending parallel to the axis of the sleeve and located immediately adjacent a cut-out in one of said opposite wall portions of said sleeve, the strip having a lower end joined to said one opposite wall portion and having an upper portion lying in the plane of the opening in said dispensing nozzle, said hinge strip thereby being located immediately adjacent said cap body side wall, with said dispensing nozzle in register with said window of the cap body, and the second end of the push button being disposed adjacent the cut-out in the other wall portion of said sleeve.

* * * * *